US008557492B2

(12) United States Patent
Hayashi et al.

(10) Patent No.: US 8,557,492 B2
(45) Date of Patent: Oct. 15, 2013

(54) TONER, DEVELOPER, AND METHOD OF MANUFACTURING TONER

(75) Inventors: Kenji Hayashi, Tokyo (JP); Mikio Kouyama, Tokyo (JP); Hiroaki Obata, Tokyo (JP); Noriyuki Kimpara, Tokyo (JP); Hiroshi Nagasawa, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 241 days.

(21) Appl. No.: 12/810,355

(22) PCT Filed: Sep. 11, 2009

(86) PCT No.: PCT/JP2009/065913

§ 371 (c)(1),
(2), (4) Date: Jun. 24, 2010

(87) PCT Pub. No.: WO2010/032686

PCT Pub. Date: Mar. 25, 2010

(65) Prior Publication Data

US 2011/0123917 A1 May 26, 2011

(30) Foreign Application Priority Data

Sep. 19, 2008 (JP) ..... 2008-240591

(51) Int. Cl.
*G03G 9/097* (2006.01)

(52) U.S. Cl.
USPC ..... 430/108.8; 430/137.14

(58) Field of Classification Search
USPC ..... 430/108.8, 137.14
See application file for complete search history.

(56) References Cited

U.S. PATENT DOCUMENTS

| | | | | |
|---|---|---|---|---|
| 6,335,139 | B1 * | 1/2002 | Gambayashi et al. | 430/111.4 |
| 2006/0188802 | A1 * | 8/2006 | Koyama et al. | 430/108.4 |
| 2007/0298344 | A1 * | 12/2007 | Maruyama et al. | 430/109.1 |

FOREIGN PATENT DOCUMENTS

| | | |
|---|---|---|
| JP | 9146305 | 6/1997 |
| JP | 2001042564 | 2/2001 |
| JP | 2001272817 | 10/2001 |
| JP | 200343746 | 2/2003 |
| JP | 2004117650 | 4/2004 |
| JP | 2004117651 | 4/2004 |
| JP | 2004151316 | 5/2004 |
| JP | 2004163612 | 6/2004 |
| JP | 2004287426 | 10/2004 |
| JP | 200757764 | 3/2007 |
| JP | 2007240828 | 9/2007 |
| JP | 2010-519045 | 6/2010 |

OTHER PUBLICATIONS

UNILIN Alcohol product sheet published by Baker Hughes, 2011.*
Unilin Product Information Sheet, Baker Hughes 2010.*
Japanese Office Action, Notice of Reasons for Refusal date mailed Sep. 4, 2012.
English translation of Japanese Office Action, Notice of Reasons for Refusal date mailed Sep. 4, 2012.

* cited by examiner

*Primary Examiner* — Peter Vajda
(74) *Attorney, Agent, or Firm* — Lucas & Mercanti, LLP

(57) ABSTRACT

In the present invention, provided is a toner suitable for fixing at low temperature, which exhibits excellent performance against thermal stress as well as mechanical stress with no generation of blocking even during storage for a long duration in an unused state, and also with no generation of tacking of toner images after fixing. Also disclosed is a toner comprising at least a binder resin, a colorant and a wax, the toner comprising a fatty acid ester wax comprising a hydroxyl group, and an aliphatic alcohol.

6 Claims, 3 Drawing Sheets

TONER, DEVELOPER, AND METHOD OF MANUFACTURING TONER

CROSS REFERENCE TO RELATED APPLICATION

This is a U.S. National Phase Application under 35 U.S.C. 371 of International Application PCT/JP2009/065913, filed Sep. 11, 2009, which claims the priority of Japanese Application No. 2008-240591, filed Sep. 19, 2007, the entire content of both Applications are hereby incorporated by reference.

TECHNICAL FIELD

The present invention relates to a toner used for image formation in an electrophotographic system, and specifically to a toner suitable for low temperature fixing to fix images at a temperature lower than that in the past.

BACKGROUND

In an electrophotographic image forming method, printed materials are generally prepared via the following steps. First, a photoreceptor is exposed to light to form a latent image on the photoreceptor and then, a toner is supplied onto the photoreceptor to develop the latent image to form a toner image. Subsequently, the toner image on the photoreceptor is transferred to a transfer material such as paper and the transferred image is subjected to heating or pressure to fix the toner image, whereby a printed material is prepared. Further, a toner remaining on the photoreceptor after transferring the toner image is removed by a cleaning device, whereby it becomes possible to conduct subsequent image formation.

In recent years, much attention has been focused on a so-called technique of fixing at low temperature, which is a technique of fixing a toner image at a temperature lower than that that in the past in order to realize reduction of electric power consumption and preparation of prints at high speed. In order to lower the fixing temperature of toner, a glass transition temperature and a softening point of a binder resin constituting the toner are lowered, and a resin exhibiting sharp behavior of melting as well as solidification with respect to temperature is desired to be employed. It has become possible to fix a toner image on a transfer material at a temperature lower than that in the past by designing a toner with a resin exhibiting such the low glass transition temperature and low softening point (refer to Patent Document 2, for example).

However, the toner for fixing at low temperature, prepared with a binder resin having a low glass transition temperature and a low softening point has had a property easily influenced by thermal stress and mechanical stress. Specifically, no stable storage performance tends to be obtained by generating a phenomenon called blocking by which toner-to-toner is firmly attached to each other, depending on the environmental conditions during aging storage of the toner. Further, when printed paper sheets immediately after fixing were piled on a paper ejection tray after preparing a large number of print paper sheets, and a large number of print paper sheets were piled and stored, generated was a phenomenon called tacking by which an image and an image, or an image and a white paper sheet were attached to each other via influence of temperature and a load of piled printed paper sheets.

In this way, demanded was not only stable storage performance, but also stability to such an extent that no tacking was generated even though a toner for fixing at low temperature underwent thermal stress or mechanical stress.

PRIOR ART DOCUMENT

Patent Document

Patent Document 1: Japanese Patent O.P.I. (Open to Public Inspection) Publication No. 2001-42564

Patent Document 2: Japanese Patent O.P.I. Publication No. 2004-163612

DISCLOSURE OF THE INVENTION

Problems to be Solved by the Invention

It is an object of the present invention to provide a toner suitable for fixing at low temperature, which exhibits excellent performance against thermal stress as well as mechanical stress with no generation of blocking even during storage for a long duration in an unused state, and also with no generation of tacking of toner images after fixing.

Means to Solve the Problems

The inventors have found out that the above-described object is accomplished by any one of the following structures.

(Structure 1) A toner comprising at least a binder resin, a colorant and a wax, the toner comprising a fatty acid ester wax comprising a hydroxyl group, and an aliphatic alcohol.

(Structure 2) The toner of Structure 1, wherein the aliphatic alcohol has 10-40 carbon atoms.

(Structure 3) The toner of Structure 1 or 2, wherein the aliphatic alcohol is contained in an amount of 3-80 mol %, based on the fatty acid ester wax having a hydroxyl group.

(Structure 4) A developer comprising the toner of any one of Structures 1-3.

(Structure 5) A method of manufacturing a toner comprising a binder resin, a colorant and a wax, comprising the steps of polymerizing a polymerizable monomer comprising a fatty acid ester wax comprising a hydroxyl group, and an aliphatic alcohol to form resin particles constituting the binder resin, and coagulating/fusing the resin particles and colorant particles to prepare the toner.

(Structure 6) A method of manufacturing a toner comprising a binder resin, a colorant and a wax, comprising the step of coagulating/fusing resin particles constituting the binder resin having been formed via polymerization of polymerizable monomers; admixture particles formed from a fatty acid ester wax comprising a hydroxyl group, and an aliphatic alcohol; and colorant particles to prepare the toner.

Effect of the Invention

It has become possible in the present invention to provide a toner suitable for fixing at low temperature, which exhibits excellent performance against thermal stress as well as mechanical stress with no generation of blocking even during storage for a long duration in an unused state, and also with no generation of tacking of toner images after fixing.

DESCRIPTION OF THE PREFERRED EMBODIMENTS

Figure 1:
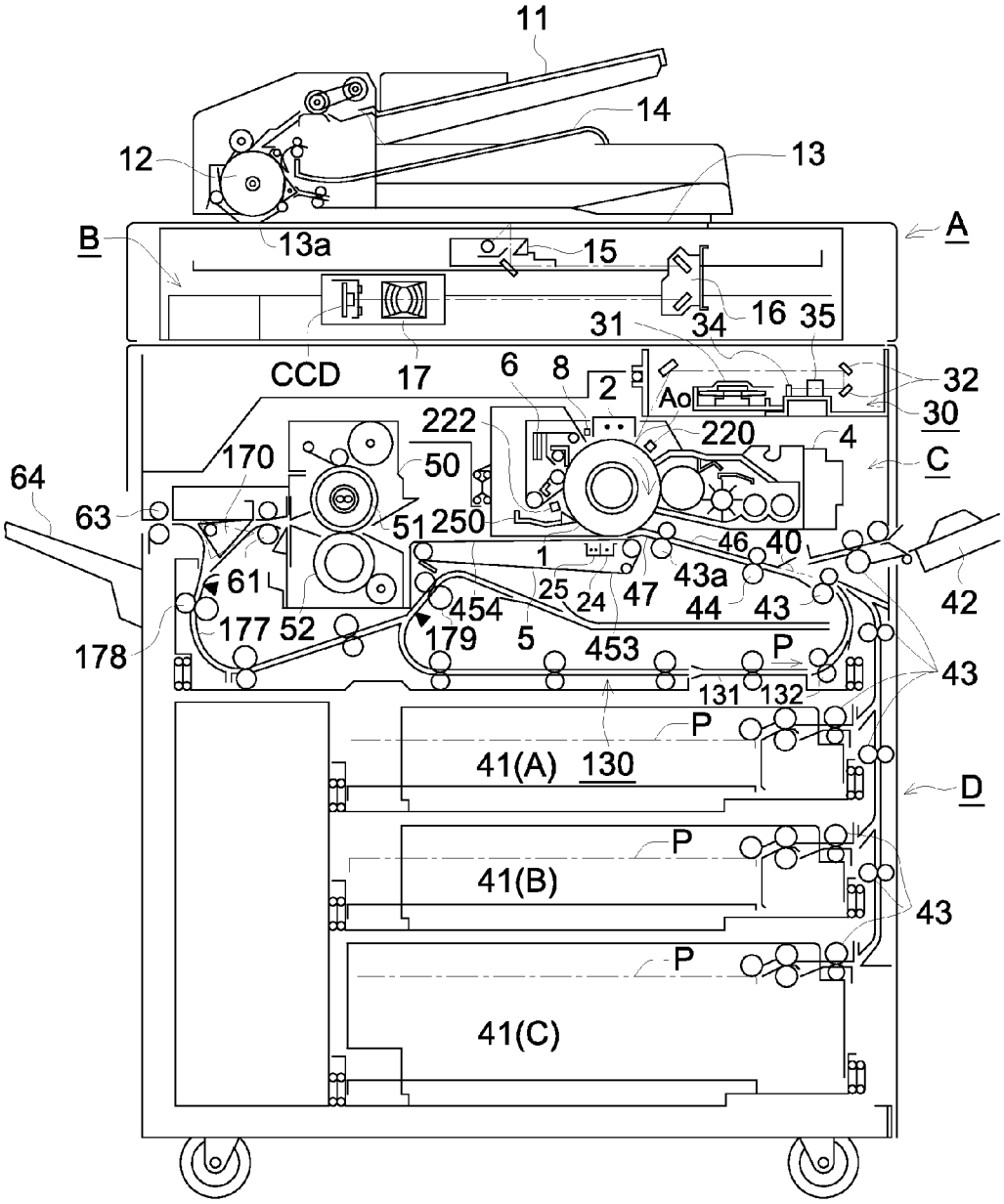
FIG. 1 shows an example of a monochromatic type image forming apparatus capable of preparing prints by using a toner of the present invention.

The inventors have found out that a toner suitable for fixing at low temperature, which exhibits excellent performance against thermal stress as well as mechanical stress with no generation of blocking even during storage for a long duration in an unused state, and also with no generation of tacking of toner images after fixing is obtained by containing a fatty acid ester wax having a hydroxyl group, and an aliphatic alcohol in a toner. The reason why the effect of the present invention is produced by the foregoing configuration is presumably that a binder resin generated flowability only to heating during fixing via action of the fatty acid ester wax having a hydroxyl group, and the aliphatic alcohol, but the flowability is inhibited in a situation other than heating during fixing.

In other words, it would appear that intermolecular interaction caused by a hydrogen bond or the like appropriately acts by forming a state where a binder resin molecule, a fatty acid ester wax molecule and an aliphatic alcohol molecule exist together in a toner particle, whereby a melting point of the toner is raised. In the present invention, it would appear that an environment where a strong intermolecular hydrogen bond is easy to be formed is realized in the presence of a hydroxyl group in the fatty acid ester wax molecule and a hydroxyl group in the aliphatic alcohol.

Therefore, it would appear that in the case of a state of hardly undergoing a large amount of heat, such as an unused toner during storage or a toner image after fixing, flowability of the binder resin is suppressed, whereby generation of blocking and tacking is avoided. On the other hand, it would appear that flowability of the binder resin is instantaneously produced by undergoing the large amount of heat during fixing to realize the fixing at low temperature, and the toner is easy to be rapidly solidified via action of a strong hydrogen bond when a heat source disappears.

In this way, it would appear in the present invention that heat and flowability have been able to be suitably controlled with respect to a binder resin easily producing flowability at low temperature in the presence of a fatty acid ester wax having a hydroxyl group, and an aliphatic alcohol. Further, it might also appear that low melt viscosity with respect to heating during fixing is generated by the above-described configuration, and elasticity is provided to a toner itself by forming a crosslinking structure generated by a comparatively mild hydrogen bond on the toner image surface after fixing to improve strength of the toner image.

Next, the present invention will be described in detail.

As previously described, the inventors have found out that the effect of the present invention is produced by utilizing a toner comprising at least a binder resin, a colorant and a wax, wherein the toner comprises a fatty acid ester wax comprising a hydroxyl group, and an aliphatic alcohol.

The fatty acid ester wax comprising a hydroxyl group, contained in a toner of the present invention will now be described. The fatty acid ester wax having a hydroxyl group, used in the present invention is a compound containing at least one bonded hydroxyl group in the structure, and is prepared by a commonly known synthetic method. It is one typified by dehydrating condensation reaction of an aliphatic carboxylic acid having a hydroxyl group and an aliphatic alcohol.

An aliphatic carboxylic acid having a hydroxyl group is generally called an aliphatic hydroxycarboxylic acid, a hydroxycarboxylic acid or a hydroxylic acid, and the aliphatic carboxylic acids each having a hydroxyl group to prepare a fatty acid ester wax used in the present invention are those shown below. That is, examples thereof include a citric acid, a malic acid, a dihydroxysuccinic acid, a catechine acid, a lactic acid, a ricinoleic acid, an isocitric acid, a mevalonic acid, a shikimic acid, a tartronic acid, a hydroxybutyric acid, a citramalic acid, a leucine acid, and a pantoic acid. Of these, a citric acid, a dihydroxysuccinic acid and a malic acid are preferable.

A usable aliphatic alcohol to form a fatty acid ester wax used in the present invention is preferably one having 10-40 carbon atoms, and is more preferably one having 12-30 carbon atoms. In addition, a straight chain structure as well as a branched chain structure may be allowed to be at the site of a hydrocarbon structure in the aliphatic alcohol.

The aliphatic alcohol, for example, is cited as follows. Examples thereof include decanol, undecanol, dodecanol, tridecanol, tetradecanol, petadecanol, hexadecanol, heptadecanol, octadecanol, nonadecanol, eicosanol, heneicosanol, docosanol, tricosanol, tetracosanol, hexacosanol, octacosanol, and triacontanol. Of these aliphatic alcohols, an aliphatic carboxylic acid employing docosanol or octadecanol is specifically preferable.

Further, a natural wax containing fatty acid ester wax having a hydroxyl group is usable, and examples of the natural wax include a carnauba wax and a rice wax. Usable is a synthetic wax such as seryl-ω-hydroxysellotate, seryl-ω-hydroxymerisate or myricyl-ω-hydroxymerisate, other than one obtained by synthesizing the above-described aliphatic carboxylic acid having a hydroxyl group and an aliphatic alcohol.

The fatty acid ester wax having a hydroxyl group has a melting point of 40-120° C., and preferably has a melting point of 50-110° C., and more preferably has a melting point of 60-90° C. The melting point falling within the above-described range presumably contributes to generation of toner heat resistance storage and fixing at low temperature.

Next, the aliphatic alcohol together with the foregoing fatty acid ester wax having a hydroxyl group, contained in a toner of the present invention will be described.

Examples of the aliphatic alcohol usable for a toner of the present invention include decanol, undecanol, dodecanol, tridecanol, tetradecanol, petadecanol, hexadecanol, heptadecanol, octadecanol, nonadecanol, eicosanol, heneicosanol, docosanol, tricosanol, tetracosanol, hexacosanol, octacosanol, and triacontanol. Specifically, 10-40 carbon atoms are preferably used, but 12-30 carbon atoms are more preferably used. In addition, a straight chain structure as well as a branched chain structure may be allowed to be at the site of a hydrocarbon structure in the aliphatic alcohol.

Examples of the aliphatic alcohol usable for a toner of the present invention include decanol, undecanol, dodecanol, tridecanol, tetradecanol, petadecanol, hexadecanol, heptadecanol, octadecanol, nonadecanol, eicosanol, heneicosanol, docosanol, tricosanol, tetracosanol, hexacosanol, octacosanol, and triacontanol. In this manner, the same structure as an alcohol component in a fatty acid ester wax having a hydroxyl group as described before, or an aliphatic alcohol to which the structure is similar is preferably used for the aliphatic alcohol usable for a toner of the present invention. Of the foregoing aliphatic alcohols, docosanol and octadecanol are preferably used.

An amount of the foregoing aliphatic alcohol added into the toner is preferably 3-80 mol %, based on the ester wax having a hydroxyl group, and more preferably 10-70 mol %, based on the ester wax having a hydroxyl group.

As to a toner of the present invention, a fatty acid ester wax having a hydroxyl group, and an aliphatic alcohol are contained in a toner particle, but these compounds can be contained in the toner particle by a commonly known method. Specifically, for example, the fatty acid ester wax having a hydroxyl group, and the aliphatic alcohol are added into a polymerization monomer solution as raw material of a binder resin to form resin particles each containing the foregoing compounds via polymerization reaction thereof. Then, toners each containing these compounds can be prepared by coagulating and fusing the resulting resin particles together with colorant particles.

A mixture of the fatty acid ester wax having a hydroxyl group, and the aliphatic alcohol is heated to a temperature higher than a melting temperature of these compounds to add the resulting into an aqueous surfactant solution heated in the same manner, and is microparticulated by a dispersing method employing ultrasonic waves or high-speed stirring. Toners each formed by containing the fatty acid ester wax having a hydroxyl group, and the aliphatic alcohol can be prepared by coagulating and fusing the particles formed from this admixture together with resin particles.

The fatty acid ester wax having a hydroxyl group, and the aliphatic alcohol in the toner of the present invention preferably have a content of 1-30% by weight, and more preferably have a content of 5-20% by weight.

Further, each of the following commonly known waxes is possible to be used in combination with the fatty acid ester wax having a hydroxyl group, and the aliphatic alcohol.

(1) Polyolefin based wax such as polyethylene wax or polypropylene wax (2) Long chain hydrocarbon based wax such as paraffin wax or sasol wax (3) Dialkylketone based wax such as distearylketone (5) Amide based wax such as ethylenediamine dibehenylamide or trimellitic acid tristearylamide As an method to add the wax into the toner, for example, provided is a method applied when containing the fatty acid ester wax having a hydroxyl group, and the aliphatic alcohol. Specifically, there is a method by which a binder resin is dissolved in the formed polymerization monomer. Further, there is also another method by which wax is heated to a temperature higher than the melting point and added into an aqueous surfactant solution heated in the same manner, and the resulting is microparticulated by a dispersing method employing ultrasonic waves or high-speed stirring to coagulate these particles together with resin particles and colorant particles, and to fuse the coagulated particles.

The toner of the present invention will be further described. A toner of the present invention contains at least a binder resin and a colorant, and contains a fatty acid ester wax having a hydroxyl group, and an aliphatic alcohol. It is possible to provide a toner suitable for fixing at low temperature, which exhibits excellent performance against thermal stress as well as mechanical stress with no generation of blocking even during storage for a long duration in an unused state, and also with no generation of tacking of toner images after fixing.

In the case of a toner of the present invention, in addition to a configuration of "containing a fatty acid ester wax having a hydroxyl group, and an aliphatic alcohol" as previously described, it is preferable that a binder resin having a glass transition temperature of 60-70° C. is used. The glass transition temperature of a binder resin can be determined by employing, for example, a DSC-7 differential scanning calorimeter (produced by Perkin Elmer Corp.) or a TAC7/DX thermal analysis controller (produced by Perkin Elmer Corp.). The measuring procedures are as follows. First, a toner of 4.5-5.0 mg is precisely weighed to two places of decimals, sealed into an aluminum pan (KIT NO. 0219-0041) and set into a DSC-7 sample holder. An empty aluminum pan is used as a reference. The measurement is conducted via temperature control of Heat-Cool-Heat at a temperature-raising rate of 10° C./min and a temperature-lowering rate of 10° C./min in the range of −30 to 200° C., and analysis is made based on data from $2^{nd}$ Heat thereof.

"Glass transition temperature" is designated as the temperature at an intersection point of an extension line of a base line before rising of the first endoergic peak and the tangential line shown at the maximum inclination in the range between the rising part of the first endoergic peak and the peak thereof.

The toner of the present invention preferably has a volume-based median diameter (D50v) of 3-20 μm, and more preferably has a volume-based median diameter (D50v) of 5-12 μm. The volume-based median diameter (D50v) of toner particles can be determined employing a device connecting a computer system for data processings to "Multisizer 3 (manufactured by Beckmann Coulter Co.)".

The measurement procedure is as follows: 0.02 g of toner particles are added into 20 ml of a surfactant solution (for example, a surfactant solution obtained by diluting a surfactant containing neutral detergent with pure water by 10 times) and dispersed by an ultrasonic homogenizer to prepare a toner dispersion. Using a pipette, the toner dispersion is poured into a beaker having ISOTON II (manufactured by Beckman Coulter Co.) within a sample stand, until reaching a measurement concentration of 5-10%. The measurement count was set to 2,500 to perform measurement. Then the aperture diameter of "Multisizer 3" was 50 μm.

Next, a method of manufacturing a toner of the present invention will be described.

The toner of the present invention contains at least a binder resin, a colorant and a wax and can be prepared by a conventional method of manufacturing the toner, and the method is not specifically limited. It is possible to prepare the toner by a method, that is, a so-called pulverization method by which the toner is prepared via kneading, pulverizing and classifying steps, for example, and by another method, that is, a so-called polymerization method by which polymerization monomers are polymerized, and at the same time, particles are formed while controlling shape and size thereof.

A toner manufacturing method via polymerization by which uniform particle size distribution or shape distribution, or sharp electrostatic charge distribution is readily achieved is preferable. Specifically, the present invention provides a toner exhibiting excellent performance against thermal stress as well as mechanical stress, with which fixing of toner images is conducted at a temperature lower than that in the past, toner images producing no tacking after the fixing can be obtained, and no blocking is produced even during storage for a ling time in an unused state. As a toner having two functions of fixing at low temperature and thermal stability, a toner having a core/shell structure is provided, but a toner manufacturing method via polymerization is preferable for preparation of such a function-separation type toner.

The toner manufacturing method via polymerization is a method of manufacturing toner particles via the step of forming resin particles by conducting polymerization reaction such as suspension polymerization or emulsion polymerization. In the present invention, a toner contains a fatty acid ester wax having a hydroxyl group, and an aliphatic alcohol, but a toner of the present invention can be prepared by adding these compounds in a polymerization process by a commonly known method. Among these polymerization methods, preferable is a method of manufacturing a toner via an emulsion association method in which resin particles are prepared via emulsion association, and toner particles are prepared by the step of coagulating/fusing the foregoing resin particles.

A method of manufacturing a toner via emulsion association as a method of manufacturing a toner of the present invention will be described. Preparation of a toner by an emulsion association method is conducted via the following steps:

(1) Step of preparing resin particle dispersion
(2) Step of preparing colorant particle dispersion
(3) Step of coagulating/fusing resin particle
(4) Ripening step
(5) Cooling step
(6) Washing step
(7) Drying step
(8) External additive treatment step Each of the steps will be described below.

(1) Step of Preparing Resin Particle Dispersion

This step is a step in which resin particles having a size of approximately 100 nm are formed via polymerization by charging polymerization monomers in an aqueous medium to form resin particles. In addition, resin particles containing a fatty acid ester wax having a hydroxyl group, and an aliphatic alcohol can be prepared by polymerizing polymerization monomers in the presence of the fatty acid ester wax having a hydroxyl group, and the aliphatic alcohol.

The expression "aqueous medium" is used herein, but the aqueous medium of the present invention is referred to as a medium composed of 50-100% by weight of water and 0-50% by weight of a water-soluble organic solvent. Examples of the commonly known water-soluble organic solvent include methanol, ethanol, isopropanol, butanol, acetone and methyl ethyl ketone.

(2) Step of Preparing Colorant Particle Dispersion

In this step, a colorant is dispersed in an aqueous medium to prepare a colorant particle dispersion in accordance with the foregoing procedure. Specifically, in the present invention, a colorant particle dispersion is prepared by using a colorant having a number average primary particle size of 30-200 nm. When preparing a toner by using such a colorant particle dispersion, the number average particle diameter of a colorant in toner particles is 1.1 to 2.5 times the number average primary particle diameter.

(3) Step of Coagulating/Fusing Resin Particle

In this step, resin particles and colorant particles are coagulated in an aqueous medium to form particles and the thus formed particles via coagulation are fused to prepare mother particles of the toner before conducting an external additive treatment (hereinafter, referred to also as colorant particles). Thus, this step corresponds to a step of coagulating resin particles in the present invention.

In this step, a coagulant of an alkali metal salt or an alkaline earth metal salt such as magnesium chloride is added into an aqueous medium containing resin particles and colorant particles to coagulate these particles. Subsequently, the aqueous medium is heated to a temperature higher than the glass transition temperature of the resin particles and higher than the melting peak temperature of the mixture to accelerate coagulation and at the same time, to fuse coagulated resin particle-to-coagulated resin particle. When reaching the intended particle diameter via progress of the coagulation, a salt such as sodium chloride or the like is added to stop coagulation, whereby the intended colored particles are formed.

In this step, resin particles containing a fatty acid ester wax having a hydroxyl group, and an aliphatic alcohol, which were prepared in the foregoing step of preparing a resin particle dispersion, are used to prepare colored particles as mother particles for the toner of the present invention. Alternatively, an admixture particle dispersion of the fatty acid ester wax having a hydroxyl group, and the aliphatic alcohol is prepared in a manner similar to the foregoing preparation of a colorant particle dispersion and the admixture particles together with resin particles and colorant particles can be also coagulated and fused to prepare colored particles.

In preparation of a toner having a core/shell structure, resin particles for the core and colorant particles are coagulated and fused to form core particles, and subsequently, resin particles to form the shell are charged thereto to coagulate and fuse them onto the core particle surface. Thus, the coagulation/fusion step is conducted two-stepwise to prepare colored particles having a core/shell structure.

(4) Ripening Step

Subsequent to the foregoing coagulation/fusion step, the reaction system is subjected to a heat treatment to ripen colored particles until the colored particles reach the intended average circularity. This ripening step is also called the shape controlling step. In the ripening step, colored particles, formed in the coagulation/fusion step, are heated to a temperature higher than the glass transition temperature of the binder resin constituting colored particles to perform shape control of the colored particles (5) Cooling Step In this step, a dispersion of colored particles is subjected to a cooling treatment (rapid cooling treatment). A cooling treatment is conducted at a cooling rate of 1-20° C./min. A cooling treatment is not specifically limited, and examples thereof include a method in which a cooling medium is introduced from the outside of a reactor and a method in which a cooling water is directly fed to the reaction system.

(6) Washing Step

This step comprises a solid-liquid separation step of separating colored particles from a colored particle dispersion which was cooled to a prescribed temperature in the foregoing step and a subsequent washing step to remove any attached surfactant, coagulant or the like from the wetted surface of separated colored particles.

In the manufacturing process, colored particles which have been separated via solid-liquid separation are usually in the form of a cake-like aggregate which is called a toner cake. The toner cake is pulverized before washing. Washing is conducted with water until electrical conductivity of the filtrate reaches a level of 10 μS/cm. Examples of methods for a solid-liquid separation include a centrifugal separation method, a reduced pressure filtration method using a Nutsche funnel and a filtration method using a filter press. The present invention is not specifically limited thereto.

(7) Drying Step

In this step, washed colored particles are dried to obtain dried colored particles. Examples of a dryer usable in this step include a spray dryer, a vacuum freeze-dryer and a reduced pressure dryer. However, it is preferred to use a standing plate dryer, a mobile plate dryer, a fluidized-bed dryer, a rotary dryer or a stirring dryer.

The moisture content of dried colored particles is preferably not more than 5% by weight, and more preferably not more than 2% by weight. In cases where dried colored particle-to-colored particle is coagulated by a weak interparticle attractive force, the aggregate may be subjected to a pulverization treatment. There are usable pulverization treatment apparatuses such as a jet mill, a HENSCHEL MIXER, a coffee mill or a food processor.

(8) External Additive Treatment Step

In this step, an external additive or a lubricant is added into dried colored particles to prepare toner particles suitable for image formation. Colored particles having been subjected to the drying step may be used as toner particles, but addition of external additives can enhance electrification of toner, fluidity and a cleaning property. Commonly known organic or inorganic particles and aliphatic metal salts can be used for these external additives. The external additive can be added in an amount of 0.1-10.0% by weight, based on the total toner, and preferably 0.5-4.0% by weight. Various external additives may be used in combination. Examples of a mixing device used during addition of external additives include a turbuler mixer, a HENSCHEL MIXER, a Nautor Mixer, a V-type mixer and a coffee mill.

A toner of the present invention containing a fatty acid ester wax comprising a hydroxyl group, and an aliphatic alcohol can be prepared via the foregoing steps. In addition, a polymerization initiator, a dispersion stabilizer and a surfactant which are usable when preparing the toner of the present invention by the above-described emulsion association method will be described later.

Next, the resin material and the colorant used in combination with a binder resin constituting a toner of the present invention will be described referring to specific examples.

The binder resin used for the toner of the present invention is not specifically limited, commonly known resins such as vinyl based resins, for example, are usable.

Specific examples of vinyl based polymerizable monomers capable of forming vinyl based resins are shown below.

(1) Styrene and Styrene Derivative:

styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, p-n-dodecylstyrene;

(2) Methacryl Acid Ester Derivative:

methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, dimethylaminoethyl methacrylate;

(3) Acrylic Acid Ester Derivative:

methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, phenyl acrylate;

(4) Olefins:

ethylene, propylene, isopbutylene;

(5) Vinyl Esters:

vinyl propionate, vinyl acetate, vinyl benzoate;

(6) Vinyl Ethers:

vinyl methyl ether, vinyl ethyl ether;

(7) Vinyl Ketones:

vinyl methyl ketone, vinyl ethyl ketone, vinyl hexyl ketone;

(8) N-Vinyl Compounds:

N-vinylcarbazole, N-vinylindole, N-vinylpyrrolidone;

(9) Others:

vinyl compounds such as vinylnaphthalene, vinylpyridine; acrylic acid or methacrylic acid derivatives such as acrylonitrile, methacrylonitrile and acrylamide.

Polymerizable vinyl based monomers constituting a resin usable in the toner of the present invention can also employ one containing an ionic dissociative group such as a carboxyl group, a sulfonic acid group or a phosphoric acid group.

Examples of those containing a carboxyl group include acrylic acid, methacrylic acid, maleic acid, itaconic acid, cinnamic acid, fumaric acid, maleic acid monoalkyl ester and itaconic acid monoalkyl ester. Examples of those containing a sulfonic acid group include styrene sulfonic acid, allylsulfosuccinic acid, and 2-acrylamido-2-methylpropane sulfonic acid. Examples of those containing a phosphoric acid group include acidophosphooxyethyl methacrylate.

Further, a resin having a crosslinking structure is possible to be prepared by employing the following polyfunctional vinyls. Specific examples of the polyfunctional vinyls are shown below.

Examples thereof include ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, and neopentyl glycol diacrylate.

Further, as an colorant usable for a toner of the present invention, those commonly known are exemplified. Specific colorants are shown below.

As a black colorant, for example, carbon blacks such as furnace black, channel black, acetylene black, thermal black, and lampblack, and also the magnetic powder of magnetite or ferrite are usable.

Examples of colorants for magenta or red include C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48: 1, C. I. Pigment Red 58: 1, C. I. Pigment Red 57: 1, C. I. Pigment Red 60, C. I. Pigment Red 63, C. I. Pigment Red 64, C. I. Pigment Red 68, C. Pigment Red 81, C. I. Pigment Red 83, C. I. Pigment Red 87, C. I. Pigment Red 88, C. I. Pigment Red 89, C. I. Pigment Red 90, C. I. Pigment Red 112, C. I. Pigment Red 114, C. I. Pigment Red 122, C. I. Pigment Red 123, C. I. Pigment Red 139, C. I. Pigment Red 144, C. I. Pigment Red 149, C. I. Pigment Red 150, C. I. Pigment Red 163, C. I. Pigment Red 166, C. I. Pigment Red 170, C. I. Pigment Red 177, C. I. Pigment Red 178, C. I. Pigment Red 184, C. I. Pigment Red 202, C. I. Pigment Red 206, C. I. Pigment Red 207, C. I. Pigment Red 209, C. I. Pigment Red 222, C. I. Pigment Red 238, and C. I. Pigment Red 269.

Examples of colorants for orange or yellow include C. I. Pigment Orange 31, C. I. Pigment Orange 43, C. I. Pigment Yellow 12, C. I. Pigment Yellow 14, C. I. Pigment Yellow 15, C. I. Pigment Yellow 17, C. I. Pigment Yellow 74, C. I. Pigment Yellow 84, C. I. Pigment Yellow 93, C. I. Pigment Yellow 94, C. I. Pigment Yellow 138, C. I. Pigment Yellow 155, C. I. Pigment Yellow 162, C. I. Pigment Yellow 180, and C. I. Pigment Yellow 185.

Further, examples of colorants for green or cyan include C. I. Pigment Blue 2, C. I. Pigment Blue 3, C. I. Pigment Blue 15, C. I. Pigment Blue 15: 2, C. I. Pigment Blue 15: 3, C. I. Pigment Blue 15: 4, C. I. Pigment Blue 16, C. I. Pigment Blue 17, C. I. Pigment Blue 60, C. I. Pigment Blue 62, C. I. Pigment Blue 66, and C. I. Pigment Green 7.

Further, examples of dyes include C. I. Solvent Red 1, C. I. Solvent Red 49, C. I. Solvent Red 52, C. I. Solvent Red 58, C. I. Solvent Red 63, C. I. Solvent Red 1, C. I. Solvent Red 111, C. I. Solvent Red 122, C. I. Solvent Yellow 2, C. I. Solvent Yellow 6, C. I. Solvent Yellow 14, C. I. Solvent Yellow 15, C.

I. Solvent Yellow 16, C. I. Solvent Yellow 19, C. I. Solvent Yellow 21, C. I. Solvent Yellow 33, C. I. Solvent Yellow 44, C. I. Solvent Yellow 56, C. I. Solvent Yellow 61, C. I. Solvent Yellow 77, C. I. Solvent Yellow 79, C. I. Solvent Yellow 80, C. Solvent Yellow 81, C. I. Solvent Yellow 82, C. I. Solvent Yellow 93, C. I. Solvent Yellow 98, C. I. Solvent Yellow 103, C. I. Solvent Yellow 104, C. I. Solvent Yellow 112, C. I. Solvent Yellow 162, C. I. Solvent Blue 25, C. I. Solvent Blue 36, C. I. Solvent Blue 60, C. I. Solvent Blue 70, C. I. Solvent Blue 93, and C. I. Solvent Blue 95.

The foregoing colorants may be used singly or in combination. The colorant content is preferably 1-30% by weight, and more preferably 2-20% by weight, based on the total toner. It is preferable that a number average primary particle diameter, depending of its kind, is approximately 10-200 nm.

A colorant is added at a time when resin particles are coagulated by adding a coagulant to color a polymer. The colorant particle surface may be treated by a coupling agent or the like.

Next, There may be incorporated, in the process of preparing the toner of the invention, inorganic organic particles having a number average primary particle diameter of 4-800 nm as an external additive to prepare the toner. Addition of an external additive results in improved fluidity or electrostatic property or achieves enhanced cleaning ability. The kinds of external additives are not specifically limited and examples thereof include inorganic particles, organic particles and a lubricant, as described below.

Commonly known inorganic particles are usable, and preferred examples thereof include silica, titania, alumina and strontium titanate particles. There may optionally be used inorganic particles having been subjected to a hydrophobilization treatment.

Specific examples of silica particles include R-805, R-976, R-974, R-972, R-812 and R-809 which are commercially available from Nippon Aerosil Co., Ltd.; HVK-2150 and H-200 which are commercially available from Hoechst Co.; TS-720, TS-530, TS-610, H-5 and MS-5 which is commercially available from Cabot Co.

Examples of titania particles include T-805 and T-604 which are commercially available from Nippon Aerosil Co. Ltd.; MT-100S, MT-100B, MT-500BS, MT-600, MT-600SS, JA-1 which are commercially available from Teika Co.; TA-300SI, TA-500, TAF-130, TAF-510 and TAF-510T which as commercially available from Fuji Titanium industry Co., Ltd.; IT-S, IT-OA, IT-OB and IT-OC which as commercially available from Idemitsu Kosan Co., Ltd.

Examples of alumina particles include RFY-C and C-604 which are commercially available from Nippon Aerosil Co., Ltd.; and TTO-55, commercially available from Ishihara Sangyo Co., Ltd.

Spherical organic particles having a number-average primary particle diameter of 10-2000 nm are usable as organic particles. Specifically, usable are styrene, methyl methacrylate homopolymer, and copolymers thereof.

Lubricants are usable to improve cleaning ability and transferability. Examples of the following fatty acid metal salts include metal salts such as zinc stearate, copper stearate, magnesium stearate and calcium stearate; metal salts such as zinc oleate, manganese oleate, iron oleate, copper oleate and magnesium oleate; metal salts such as zinc palmitate, copper palmitate, magnesium palmitate and calcium palmitate; metal salts such as zinc linolate and calcium linolate; and metal salts such as zinc ricinolate and calcium ricinolate.

Such an external additive or lubricant preferably has an addition amount of 0.1-10.0% by weight, based on the total toner.

A polymerization initiator, a dispersion stabilizer used when preparing a toner of the present invention by an emulsion association method will be described.

First, commonly known oil-soluble or water-soluble polymerization initiators are usable when forming a binder resin constituting the toner of the present invention. As the oil-soluble polymerization initiator, there are azo- or diazo based polymerization initiators and peroxide based polymerization initiators shown below.

(1) Azo- or Diazo Based Polymerization Initiators, 2,2'-azobis-(2,4-dimethylvaleronitrile), 2,2'-azobisisobutylonitrile, 1,1'-azobis(cyclohexane-1-carbonitrile), 2,2'-azobis-4-methoxy-2,4-dimethylvaleronitrile, and azobisisobutylonitrile (2) Peroxide Based Polymerization Initiators, benzoyl peroxide, methyl ethyl ketone peroxide, diisopropylperoxycarbonate, cumene hydroperoxide, t-butyl hyroperoxide, di-t-butyl peroxidedicumyl peroxide, 2,4-dichlorobenzoyl peroxide, lauroyl peroxide, 2,2-bis-(4,44-butylperoxycyclohexyl)-propane, and tris-(t-butylperoxy) triazine Further, water-soluble radical polymerization initiators are usable when forming resin particles by an emulsion polymerization method. Examples of water-soluble polymerization initiators include persulfates such as potassium persulfate and ammonium persulfate; azobisaminodipropane acetic acid salt, azobiscyanovaleric acid and a salt thereof, and hydrogen peroxide.

Commonly known chain-transfer agents are usable in order to adjust molecular weight of resin particles. Specific examples thereof include octylmercaptan, dodecylmercaptan, tert-dodecylmercaptan; n-octyl-3-mercaptopropionic acid ester, terpinolene, carbon tetrabromide, and α-methylstyrene dimmer.

In the present invention, a tone is prepared in such a manner that polymerizable monomers dispersed in an aqueous medium are polymerized, or resin particles dispersed in an aqueous medium are coagulated and fused. Accordingly, it is preferred to use a dispersion stabilizer to stably disperse the toner materials in the aqueous medium. Examples of the dispersion stabilizer include calcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica and alumina. Further, polyvinyl alcohol, gelatin, methylcellulose, sodium dodecybenzenesulfate, ethylene oxide adduct, and sodium higher alcohol sulfate. Generally, those used as surfactants are usable as dispersion stabilizers.

Further, in order to conduct polymerization of polymerizable monomers in an aqueous medium, surfactants are used to disperse such monomers in the form of oil droplets in an aqueous medium. Surfactants usable therein are not specifically limited, but ionic surfactants described below are preferred. Such ionic surfactants include, for example, sulfonates, sulfuric acid ester salts and carboxylic acid salts. Examples of sulfonates include sodium dodecylbenzenesulfate, sodium arylalkylpolyethersulfonate, sodium 3,3-disulfondisphenylurea-4,4-diazo-bis-amino-8-naphthol-6-sulfonate, ortho-carboxybenzene-azo-dimethylaniline, and sodium 2,2,5,5-tetramethyl-triphenylmethane-4,4-diazo-bis-b-naphthol-6-sulfonate.

Examples of sulfuric acid ester salts include sodium dodecylsulfonate, sodium tetradecylsulfonate, sodium pentadecylsulfonate, and sodium octylsulfonate. Examples of fatty acid salts include sodium oleate, sodium laurate, sodium caprate, sodium caprylate, sodium caproate, potassium stearate, and calcium oleate.

Nonionic surfactants are also usable. Specific examples thereof include polyethylene oxide, polypropylene oxide, a combination of polypropylene oxide and polyethylene oxide, ester of polyethylene glycol and a higher fatty acid, alkylphenol polyethylene oxide, ester of polypropylene oxide and a higher fatty acid, and sorbitan ester.

The toner of the present invention is usable not only as a two-component developer comprised of a carrier and a toner, but also as a non-magnetic single-component developer consisting of a toner.

The use of a toner of the present invention as a two-component developer enables full-color printing by employing the after-mentioned tandem system image forming apparatus. Magnetic particles used as a carrier of the two-component developer can use commonly known materials, e.g., metals such as iron, ferrite and magnetite and alloys of the foregoing metals and metals such as aluminum or lead. Of these, ferrite particles are preferred.

A volume-based average particle diameter of a carrier is preferably 15-100 μm, and more preferably 25-80 μm. A saturation magnetization is preferably 20-80 emu/g. The use of a carrier exhibiting such a particle diameter and saturation magnetization enables to form a soft magnetic brush on a development sleeve during image formation, leading to formation of a toner image exhibiting excellent sharpness. The above-described volume-based average particle diameter and saturation magnetization can be determined by a measurement instrument known in the art. Specifically, the volume-based average particle diameter can be measured by a laser diffraction sensor HELOS (produced by SYMPATECS Co., Ltd.) equipped with a wet disperser, and the saturation magnetization can be measured by, for example, a direct current magnetization characteristic automatic recorder 3257-35 (produced by Yokokawa Denku Co., Ltd.).

A toner and a carrier are mixed to obtain a two-component developer via a commonly known method. The toner content is preferably 2-10% by weight, based on the carrier. A mixer usable in the present invention is not specifically limited, and usable are a Nauter mixer and a W-cone or V-shape mixer.

When used as a nonmagnetic single-component developer without a carrier to perform image formation, a toner is charged with being rubbed or is pressed onto a charging member or the developing roller surface. Image formation in a nonmagnetic single-component development system can simplify the structure of a developing device, resulting in an advantage of compactification of the entire image forming apparatus. Therefore, the use of a toner of the present invention as a single-component developer can achieve full-color printing in a compact printer, making it feasible to prepare full-color prints of excellent color reproduction even in a space-limited working environment.

Next, an image forming method with a toner of the present invention will be described. The image forming method of the present invention employs the foregoing "a toner comprising at least a binder resin, a colorant, a fatty acid ester wax comprising a hydroxyl group, and an aliphatic alcohol" to conduct printing by forming a toner image on a transfer paper via at least the following steps.

(1) forming a latent image on the surface of an electrophotographic photoreceptor, (2) developing the electrophotographic latent image formed on the surface of an electrophotographic photoreceptor to form a toner image, (3) transferring the toner image onto the surface of a transfer material, and (4) thermally fixing the toner image transferred onto the transfer material.

FIG. 1 shows an example of a monochromatic type image forming apparatus capable of preparing prints by using a toner of the present invention. An image forming apparatus 1 shown in FIG. 1, is a digital system image forming apparatus equipped with image reading section A, image processing section B, image forming section C and transfer paper conveyance section D.

An automatic manuscript feeder to automatically convey a manuscript is provided above image reading section A. A manuscript placed on manuscript-setting table 11 is conveyed sheet by sheet by manuscript-conveying roller 12 and read at reading position 13*a* to read images. A manuscript having finished manuscript reading is discharged onto manuscript discharge tray 14 by manuscript-conveying roller 12.

On the other hand, when the image of a manuscript placed on platen glass 13 to read it, the manuscript image is read by a lighting lamp constituting a scanning optical system and plural mirror units 15 and 16 composed of plural mirrors.

The image read in image reading section A is formed through projection lens 17 onto the acceptance surface of an image sensor CCD as a line sensor. Aligned optical images formed on the image sensor CCD are sequentially photoelectrically converted into electric signals (luminance signals), then subjected A/D conversion and further subjected to processings such as density conversion and a filtering treatment in image processing section B, thereafter, the image data are temporarily stored in memory.

In image forming section C, provided is drum-shaped photoreceptor 1 as an image carrier and in its surrounding, charging device 2, potential sensor 220 to detect the surface potential of the charged photoreceptor, developing device 4, transfer device 5, cleaning device 6 for the photoreceptor 21 and PCL 8 as a photo-neutralizer (pre-charge lamp) are disposed in the order to carry out the respective operations. Reflection density detector 222 to measure the reflection density of a patch image developed on photoreceptor 1 is provided downstream from developing device 4. Photoreceptor 1 is rotatably driven clockwise, as indicated.

After having been uniformly charged by charging device 2, photoreceptor 1 is imagewise exposed to light from imagewise exposure device 3, based on image signals from the memory of image processing section B. Imagewise exposure device 3 exposes the photoreceptor to light at the position of Ao to form an electrostatic latent image on the surface of photoreceptor 1.

The electrostatic latent image on photoreceptor 1 is developed by developing device 4 to form a toner image on the surface of photoreceptor 1

Transfer paper conveyance section D is equipped with paper supplying units 41(A), 41(B) and 41(C) as paper supply unit 41*e* to store transfer paper P differing in size, and paper hand-feeding unit 42 is laterally provided, and transfer paper P chosen from either one of them is fed by guide roller 43 along conveyance route 40. After fed paper P is temporarily stopped by paired paper feeding registration rollers 44 to make correction of tilt and bias of transfer paper P, paper feeding is again started and the paper is guided to conveyance route 40, roller before transferring 43*a*, paper feeding route 46 and entrance guide plate 47. A toner image on photoreceptor 1 is transferred onto transfer paper P at the position of Bo by transfer pole 24 and separation pole 25. Transfer paper P is separated from the surface of photoreceptor 21 and conveyed to fixing device 50 by transfer conveyance belt 5.

Fixing device 50 is fitted with fixing roller 51 and pressure roller 52 and allows transfer paper P to pass through between fixing roller 51 and pressure roller 52 to fix the toner by heating and pressure. Transfer paper P having completed fixing of the toner image is discharged onto paper discharge tray 64.

Image formation on one side of transfer paper P is described above and in the case of two-sided copying, paper discharge switching member 170 is switched over, and transfer paper guide section 177 is opened and transfer paper P is conveyed in the direction of the dashed arrow. Further, transfer paper P is conveyed downward by conveyance mechanism 178 and switched back in transfer paper reverse section 179, and the rear end of transfer paper P becomes the top portion and is conveyed to the inside of paper feeding unit 130 for two-sided copying. Further, transfer paper P is conveyed downward by conveyance mechanism 178 and switched back in transfer paper reverse section 179, and the rear end of transfer paper P becomes the top portion and is conveyed to the inside of paper feeding unit 130 for two-sided copying. Transfer paper P is moved along conveyance guide 131 in the paper feeding direction, transfer paper P is again fed by paper feeding roller 132 and guided into transfer route 40. According to the foregoing procedure, a toner image can be formed on the back surface of transfer paper P.

In an image forming apparatus of the present invention, constituent elements such as a photoreceptor, a developing device and a cleaning device may be integrated as a process cartridge and this unit may be freely detachable. Further, an electrostatic charger, an image exposure device, a transfer or separation device and a cleaning device are integrated with a photoreceptor to form a process cartridge also as a single detachable unit from the apparatus main body.

A toner of the present invention is usable for a high-speed image forming apparatus at a printing speed of 400 mm/sec (output performance of 85 paper sheets/min in A-4 size paper conversion), for example. As such the high-speed image forming apparatus, there is, for example, a printer suitable POD (print-on-demand) capable of preparing several thousand prints all at one on demand.

Figure 2:
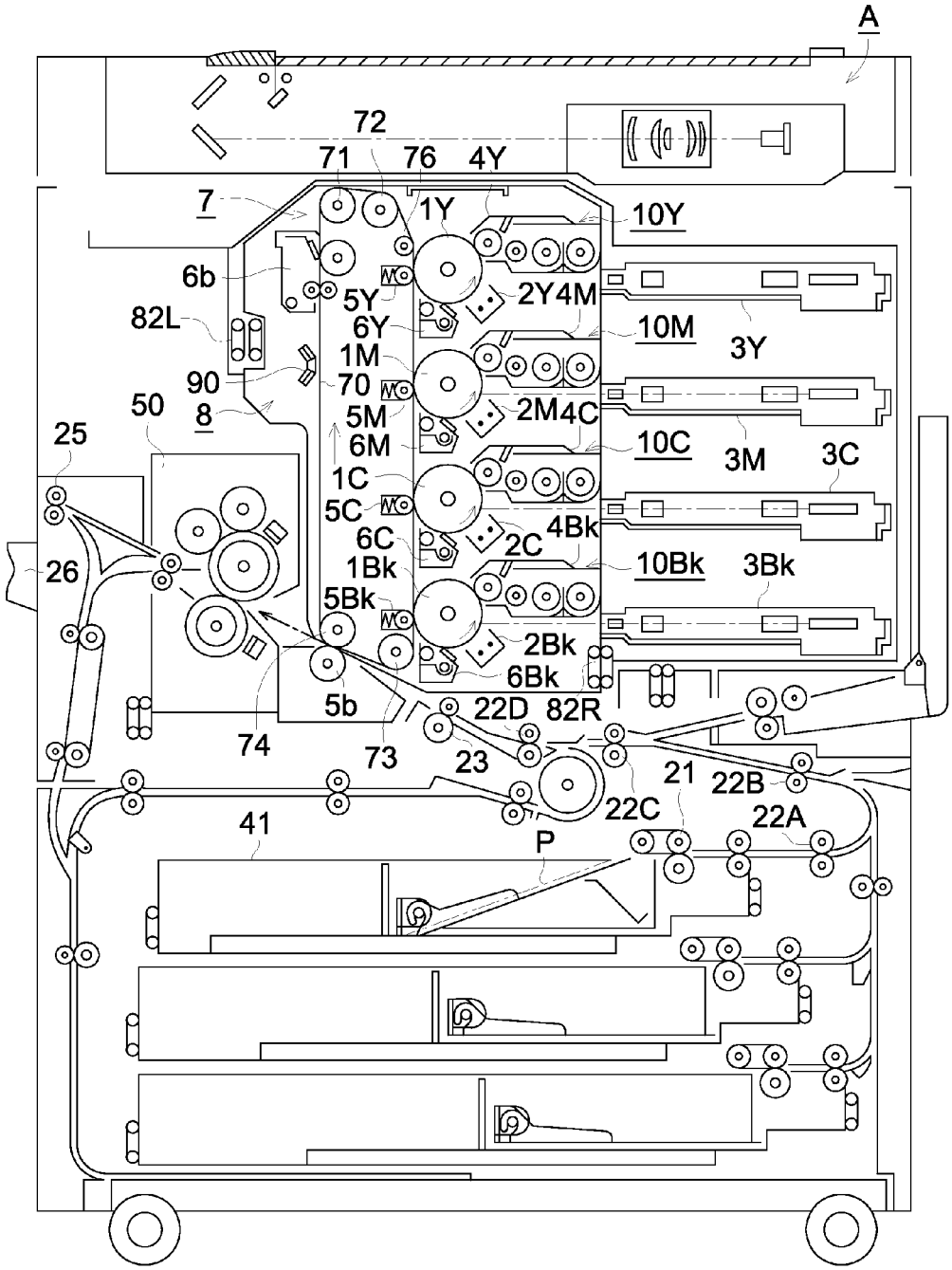
FIG. 2 shows an example of a tandem type color image forming apparatus capable of using a toner of the present invention.

FIG. 2 is a schematic diagram showing an example of an image forming apparatus to form color images employing a toner of the present invention. In FIG. 2, 1Y, 1M, 1C and 1Bk each represent a photoreceptor, 4Y, 4M, 4C and 4Bk each represent a developing device, 5Y, 5M, 5C and 5Bk each represent a primary transfer roll as a primary transfer device, 5A represents a secondary transfer roll as a secondary transfer device, 6Y, 6M, 6C and 6Bk each represent a cleaning device, 7 represents an intermediate transfer body unit, 24 represents a heat roll type fixing device, and 70 represents an intermediate transfer body.

This image forming apparatus called a tandem type color image forming apparatus comprises a plurality of image forming sections 10Y, 10M, 10C, and 10Bk, endless-belt-shaped intermediate transfer body unit 7, endless-belt-shaped sheet convey device 21 to convey recording member P, and heat roll type fixing device 50 as a fixing device. Document image reading device A is placed on the upper portion of the image forming apparatus.

Image forming section 10Y forming the yellow image as one toner image out of different colors formed on each photoreceptor comprises drum-shaped photoreceptor 1Y as the first photoreceptor, charging device 2Y placed around the photoreceptor 1Y, exposure device 3Y, developing device 4Y, primary transfer roll 5Y as a primary transfer device, and cleaning device 6Y.

Image forming section 10M forming the magenta image as one toner image of another different color comprises drum-shaped photoreceptor 1M as the first photoreceptor, charging device 2M placed around the photoreceptor 1M, exposure device 3M, developing device 4M, primary transfer roll 5M as a primary transfer device, and cleaning device 6M. The image forming section 10C forming the cyan image further as one toner image of another different color comprises drum-shaped photoreceptor 1C as the first photoreceptor, charging device 2C placed around the photoreceptor 1C, exposure device 3C, developing device 4C, primary transfer roll 5C as a primary transfer device, and cleaning device 6C. Image forming section 10Bk forming the black image further as one toner image of another different color comprises drum-shaped photoreceptor 1Bk as the first photoreceptor, charging device 2Bk placed around the photoreceptor 1Bk, exposure device 3K, developing device 4Bk, primary transfer roll 5Bk as a primary transfer device, and cleaning device 6Bk.

Endless-belt-shaped intermediate transfer body unit 7 is windingly wound with a plurality of rolls, and has endless-belt-shaped intermediate transfer body 70 as an intermediate transfer endless-belt-shaped second image carrier arranged to be supported and capable of rotation.

Color images formed by image forming sections 10Y, 10M, 10C, and 10Bk each are sequentially transferred onto rotating endless-belt-shaped intermediate transfer body 70 by primary transfer rolls 5Y, 5M, 5C, and 5Bk so that a composite color image is formed. Recording member P of a sheet as a transfer material received in sheet feeding cassette 20 is fed by sheet feeding device 21, conveyed to secondary transfer roll 5A as a secondary transfer device through a plurality of intermediate rolls 22A, 22B, 22C, 22D, and registration roll 23, and then, the color image is secondarily transferred onto recording member P all at once. Recording member P on which the color image has been transferred is fixed by heat roll type fixing device 50, sandwiched by paper-ejection roll 25, and mounted on paper-ejection tray 26 outside the machine.

On the other hand, after the color image has been transferred onto recording member P by secondary transfer roll 5A, residual toner is removed from endless-belt-shaped intermediate transfer body 70, from which recording member P has self-striped, with cleaning device 6A.

During image forming processing, primary transfer roll 5Bk is constantly pressed against photoreceptor 1K. Other primary transfer rolls 5Y, 5M, and 5C are pressed against photoreceptors 1Y, 1M, and 1C, respectively only during color image formation.

Secondary transfer roll 5A is pressed against endless-belt-shaped intermediate transfer body 70 only when recording member P passes through here and the secondary transfer is carried out.

In this way, toner images are formed on photoreceptors 1Y, 1M, 1C and 1Bk via electrification, exposure and development, toner images of each color are superimposed on endless-belt-shaped intermediate transfer body 70 to be transferred into transfer material P all at once, and to be subsequently fixed via applied pressure and heating by fixing device 50. As to photoreceptors 1Y, 1M, 1C and 1Bk after transferring toner images into recording member P, toner remaining on the photoreceptors is cleaned during transfer employing cleaning device 6A, and a cycle of the above-described electrification, exposure and development is subsequently carried out to conduct the next image formation.

Figure 3:
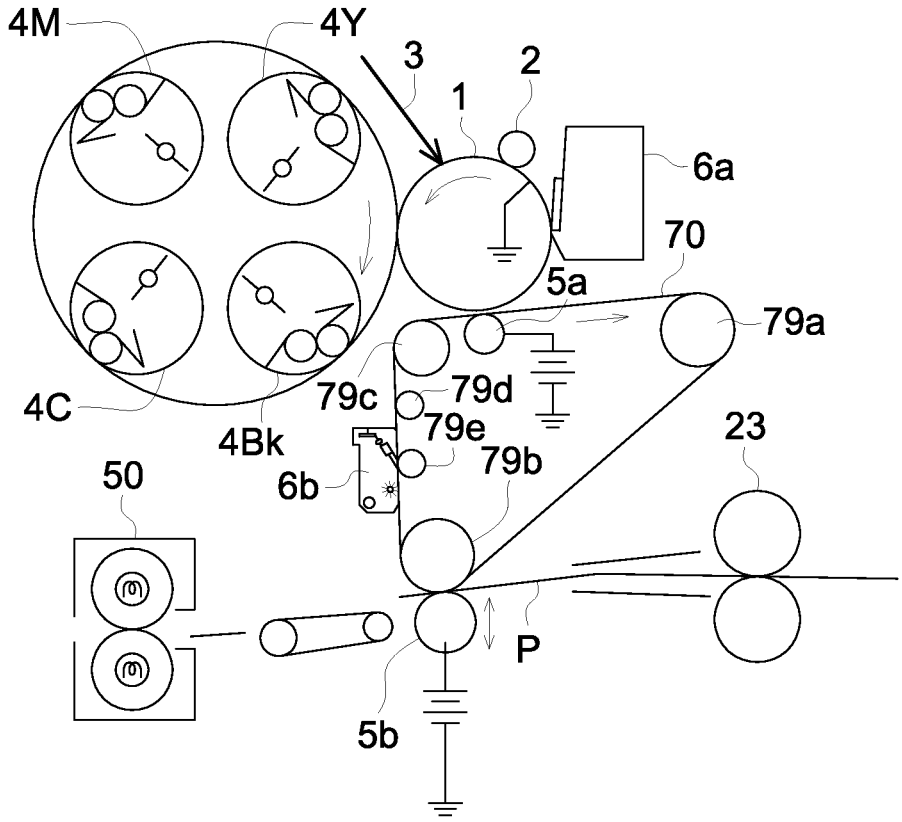
FIG. 3 shows another example of a color image forming apparatus capable of using a toner of the present invention.

Next, similarly to FIG. 2, FIG. 3 also shows a schematic cross-sectional view of a color image forming apparatus, but it has a different form than that of the image forming apparatus shown in FIG. 2. The image forming apparatus of FIG. 3 comprises, around an organic photoreceptor, an electrostatic-charging device, an exposure device, plural developing devices, a transfer device, a cleaning device and an intermediate transfer body. The intermediate transfer body 70 of an endless belt form employs an elastomer of moderate resistance.

Numeral 1 designates a rotary drum type photoreceptor, which is repeatedly used as an image forming body, is rotatably driven anticlockwise, as indicated by the arrow, at a moderate circumferential speed. Photoreceptor 1 is uniformly subjected to an electrostatic-charging treatment at a prescribed polarity and potential by charging device 2, while being rotated. Subsequently, photoreceptor 1 is subjected to imagewise exposure via imagewise exposure device 3 to form an electrostatic latent image corresponding to a yellow (Y) component image (color data) of the objective color image.

Next, the electrostatic latent image is developed by a yellow toner of a first color in yellow (Y) developing device 4Y: developing step (the yellow developing device). At that time, the individual developing devices of the second to fourth developing device 4M, 4C and 4Bk (magenta developing device, cyan developing device, black developing device) are off in operation and do not act onto photoreceptor 1 and the yellow toner image of the first color is not affected by the second to fourth developing devices.

Intermediate transfer body 70 is rotatably driven clockwise at the same circumferential speed as that of photoreceptor 1, while being tightly tensioned onto rollers 79*a*, 79*b*, 79*c*, 79*d* and 79*e*.

The yellow toner image formed and carried on photoreceptor 1 is successively transferred (primary-transferred) onto the outer circumferential surface of intermediate transfer body 70 by an electric field formed by a primary transfer bias applied from primary transfer roller 5*a* to intermediate transfer body 70 in the course of being passed through the nip between photoreceptor 1 and intermediate transfer body 70.

The surface of photoreceptor 1 which has completed transfer of the yellow toner image of the first color is cleaned by cleaning device 6*a*.

In the following, a magenta toner image of the second color, a cyan toner image of the third color and a black toner image of the fourth color are successively transferred onto intermediate transfer body 70 and superimposed to form superimposed color toner images corresponding to the intended color image.

Secondary transfer roller 5*b*, which is allowed to bear parallel to a secondary transfer opposed roller 79*b*, is disposed below the lower surface of intermediate transfer body 70, while being kept in the state of being separable.

The primary transfer bias for transfer of the first to fourth successive color toner images from photoreceptor 1 onto intermediate transfer body 70 is at the reverse polarity of the toner and applied from a bias power source. The applied voltage is, for example, in the range of +100 V to +2 kV.

In the primary transfer step of the first through third toner images from photoreceptor 1 to intermediate transfer body 70, secondary transfer roller 5*b* and cleaning device 6*b* for the intermediate transfer body are each separable from intermediate transfer body 70.

The superimposed color toner image which was transferred onto intermediate transfer body 70 is transferred to transfer material P as the second image bearing body in the following manner. Concurrently when secondary transfer roller 5*b* is brought into contact with belt of the intermediate transfer body 70, transfer material P is fed at a prescribed timing from a pair of paper-feeding registration rollers 23, through a transfer paper guide, to the nip in contact with the belt of intermediate transfer body 70 and secondary transfer roller 5*b*. A secondary transfer bias is applied to second transfer roller 5*b* from a bias power source. This secondary bias transfers (secondarily transfers) the superimposed color toner image from intermediate transfer body 70 to transfer material P as a secondary transfer material. Transfer material P having the transferred toner image is introduced to fixing device 50 and is subjected to heat-fixing.

EXAMPLE

Next, the present invention will be specifically described referring to examples, but embodiments of the present invention are not limited thereto. In the following examples, "part(s)" represents part(s) by weight unless otherwise specified.

1. Synthesis of "Fatty Acid Ester Waxes 1-6"

(1) Synthesis of "Fatty Acid Ester Waxes 1-4"

In a reaction vessel fitted with a stirrer, a temperature sensor, a condenser and a nitrogen gas introducing device, charged were 155 parts of a citric acid, 790 parts of docosanol and a sulfonic acid as an acid catalyst, and a reaction treatment was conducted under nitrogen flow at 120° C. for 3 hours. Thereafter, an aqueous sodium hydroxide solution and hydrogen peroxide water were added therein to synthesize "fatty acid ester wax 1" via filtration.

"Fatty acid ester wax 2" was prepared similarly to the foregoing synthesis of "fatty acid ester wax 1", except that the addition amount of the citric acid was changed to 180 parts, and 790 parts of docosanol were replaced by 760 parts of octadecanol. Further, "fatty acid ester wax 3" was prepared similarly to the foregoing synthesis of "fatty acid ester wax 1", except that 155 parts of the citric acid was replaced by 175 parts of a dihydroxysuccinic acid, and the addition amount of docosanol was changed to 762 parts. Further, "fatty acid ester wax 4" was prepared similarly to the foregoing synthesis of "fatty acid ester wax 1", except that 155 parts of a citric acid were replaced by 160 parts of a malic acid, and the addition amount of docosanol was changed to 779 parts.

(2) Synthesis of "Fatty Acid Ester Waxes 5 and 6"

"Fatty acid ester wax 5" was prepared similarly to the foregoing synthesis of "fatty acid ester wax 1", except that 155 parts of a citric acid were replaced by 490 parts of a behenic acid, the addition amount of docosanol was changed to 4-70 parts, and reaction temperature and the reaction time were set to 220° C. and 15 hours, respectively. Further, "fatty acid ester wax 6" was prepared similarly to the foregoing synthesis of "fatty acid ester wax 5", except that the addition amount of a behenic acid was changed to 851 parts, and 4-70 parts of docosanol were replaced by 85 parts of pentaerythritol.

Carboxylic acids and alcohol compounds used in the synthesis of the above-described "fatty acid ester waxes 1-6" are shown in Table 1.

TABLE 1

| | Constituent compounds | |
|---|---|---|
| Fatty acid ester wax No. | Carboxylic acid | Alcohol |
| 1 | Citric acid | Docosanol |
| 2 | Citric acid | Octadecanol |
| 3 | Dihydroxysuccinic acid | Docosanol |
| 4 | Malic acid | Docosanol |
| 5 | Behenic acid | Docosanol |
| 6 | Behenic acid | Pentaerythritol |

2. Preparation of "Toners 1-23"

2-1. Preparation of "Toner 1"

"Colored particle 1" as a mother particle for "Toner 1" having a core/shell structure was prepared via the following procedure.

(1) Preparation of "Colorant Particle Dispersion C"

In 160 parts by weight of deionized water, charged were 11.5 parts by weight of sodium n-dodecylsulfate, and dissolved while stirring to prepare an aqueous surfactant solution. Twenty five parts of C. I. Pigment Blue 15:3 were gradually added into this aqueous surfactant solution, and dispersed employing CLEAR MIX W-MOTION CLM-0.8 (produced by M Technique Co.) to obtain "colorant microparticle dispersion C".

"Colorant particle C" contained in "colorant particle dispersion C" had a volume-based median diameter of 98 nm. The volume-based median diameter was measured employing MICROTRAC UPA-150 (produced by HONEYWELL CORP.) under the following conditions.

Sample refractive index: 1.59
Sample specific gravity 1.05 (spherical particle conversion)
Solvent refractive index: 1.33
Solvent viscosity: 0.797 (at 30° C.) and 1.002 (at 20° C.)
Zero-point adjustment: Adjustment made by adding deionized water into a measurement cell.

(2) Preparation of "Mixture Particle Dispersion D of Fatty Acid Ester Wax 1 and Docosanol"

After preparing a mixture of 21 parts of "fatty acid ester wax 1" and 2.5 parts of "docosanol", "mixture particle dispersion D of Fatty acid ester wax 1 and docosanol" was prepared similarly to preparation of the foregoing "colorant particle dispersion C". Specifically, 25 parts of the foregoing mixture by which the foregoing "C. I. Pigment Blue 15:3" was replaced were gradually added into the foregoing aqueous surfactant solution to prepare it employing "CLEAR MIX W-MOTION CLM-0.8 (manufactured by M Technique Co.)". "Particle D" in the foregoing "mixture particle dispersion D of fatty acid ester wax 1 and docosanol" had a volume-based median diameter of 98 nm. In addition, the volume-based median diameter was obtained under the above-described measurement conditions.

(3) Preparation of "Core Resin Particle 1"

Core resin particle 1 having a multilayer structure was prepared via the following first polymerization, second polymerization and third polymerization steps.

(a) First Polymerization

Into a reaction vessel fitted with a stirrer, a temperature sensor, a condenser and a nitrogen gas-introducing device, charged were 4 parts by weight of an anionic surfactant represented by Formula 1 together with 3040 parts by weight of deionized water to prepare an aqueous surfactant solution.

$$C_{10}H_{21}(OCH_2CH_2)_2SO_3Na \quad \text{(Formula 1)}$$

After a polymerization initiator solution in which 10 parts by weight of potassium persulfate (KPS) was dissolved in 400 parts by weight of deionized water was added into the above-described aqueous surfactant solution, and heated to a temperature of 75° C., a monomer mixture solution formed of the following compounds was dropwise added to the reaction vessel spending one hour.

To the above-described aqueous surfactant solution.

| | |
|---|---|
| Styrene | 532 parts by weight |
| n-butyl acrylate | 200 parts by weight |
| Methacrylic acid | 68 parts by weight |
| n-octylmercaptane | 16.4 parts by weight |

After completing addition of the foregoing monomer mixture solution, this system was heated while stirring at 75° C. for 2 hours to conduct polymerization (the first polymerization) to prepare "resin particle dispersion A1". "Resin particle A1" in prepare "resin particle dispersion A1" having been prepared in the first polymerization had a weight average molecular weight of 16,500.

(b) Second Polymerization

To a flask fitted with a stirrer, charged was a monomer mixture solution of the following compounds. Subsequently, 84 parts by weight of "fatty acid ester wax 1" and 9.8 parts by weight of "docosanol" as aliphatic alcohol having 22 carbon atoms were added and dissolved with heating at 84° C. to prepare a monomer solution in such a manner. In addition, an addition amount of the foregoing "docosanol" is 39.9 mol %, based on the foregoing "fatty acid ester wax 1".

| | |
|---|---|
| Styrene | 233 parts by weight |
| n-butyl acrylate | 123.7 parts by weight |
| Methacrylic acid | 24.5 parts by weight |
| n-octylmercaptane | 3.48 parts by weight |

An aqueous surfactant solution was prepared by dissolving 3 parts by weight of the foregoing anionic surfactant in 1560 parts by weight of deionized water, and heated at 80° C. Into this aqueous surfactant solution, added was 32.8 parts by weight of the foregoing "resin particle A1" (solid content conversion), and a monomer solution containing the foregoing "fatty acid ester wax 1" and "docosanol" was further added, followed by a mixing dispersion treatment for 30 minutes employing a mechanical stirrer equipped with a circulation pass, CLEARMIX (produced by M Technique Co.) to prepare an emulsified particle dispersion containing emulsion particles having a dispersion particle diameter of 340 nm.

Next, a polymerization initiator solution in which 6 parts by weight of potassium persulfate were dissolved in 200 parts by weight of deionized water was added into the foregoing emulsified particle dispersion. This system was heated while stirring at 80° C. for 3 hours to conduct polymerization (second polymerization) to prepare "resin particle dispersion A2". "Resin particle A2" in "resin particle dispersion A2" prepared in the second polymerization had a weight average molecular weight of 23,000.

(c) Third Polymerization

Into "resin particle dispersion A2" obtained in the above-described second polymerization, added was a polymerization initiator solution in which 3.19 parts by weight of potassium persulfate was dissolved in 130 parts by weight of deionized water, and a monomer admixture containing the following compounds was dropwise added at 80° C. for one hour.

| | |
|---|---|
| Styrene | 173 parts by weight |
| n-butyl acrylate | 83.4 parts by weight |
| n-octylmercaptane | 4.16 parts by weight |

After completing the addition, the mixture was heated while stirring for 2 hours to conduct polymerization (third polymerization). After completing the polymerization, the mixture was cooled to 28° C. to prepare "core resin particle dispersion 1". "Core resin particle 1" in "core resin particle dispersion 1" prepared in the third polymerization had a weight average molecular weight of 26,800.

(4) Preparation of "Shell Resin Particle"

"Shell resin particle 1" was prepared via the polymerization reaction and a treatment after reaction, similarly to preparation of the foregoing "core resin particle 1", except that the monomer mixture solution used in the first polymerization was replaced by those described below.

| | |
|---|---|
| Styrene | 119 parts by weight |
| 2-ethylhexyl acrylate | 33 parts by weight |
| Methacrylic acid | 8 parts by weight |
| n-octylmercaptane | 4.5 parts by weight |

(5) Preparation of "Toner 1"

"Colored particle 1" as a mother particle for toner was prepared by the following procedures.

(a) Formation of Core

Into a reaction vessel fitted with a stirrer, a temperature sensor, a condenser and a nitrogen gas introducing device, charged was the following composition, followed by stirring.

| | |
|---|---|
| Core resin particle | 420 parts by weight (solid content conversion) |
| Deionized water | 900 parts by weight |
| Colorant particle 1 | 200 parts by weight (solid content conversion) |

The temperature inside a reaction vessel was adjusted to 30° C., and an aqueous 5 mol/liter sodium hydroxide solution was added to adjust pH to 10.

Next, an aqueous solution in which 2 parts by weight of magnesium chloride hexahydrate were dissolved in 1000 parts by weight of deionized water was added while stirring at 30° C. for 10 minutes. After standing for 3 minutes, the system was heated to 65° C. spending 60 minutes to conduct association of the above-described particles. Employing Multisizer 3 (manufactured by Beckman Coulter Inc.), the associated particle diameter was measured, and the association was stopped when coagulated particles reached a volume based median diameter of 5.5 μm by adding an aqueous solution in which 40.2 parts by weight of sodium chloride were dissolved in 1000 parts by weight of deionized water.

After terminating the association, a ripening treatment was conducted via heating while stirring at 70° C. for one hour to allow fusion to continue, whereby "core 1" was prepared.

The average circularity of "core 1", which was measured by FPIA 2000 (produced by Sysmex Co.), was 0.92.

(b) Formation of Shell

Next, into the foregoing solution maintained at 65° C., added was 210 parts by weight (solid content conversion) of "shell resin particle 1". Further, an aqueous solution in which 2 parts by weight of magnesium chloride hexahydrate were dissolved in 1000 parts by weight of deionized water was added so ending 10 minutes, and the mixture was subsequently heated to 70° C. while stirring for one hour. In this way, after "shell resin particle 1" was fused on the surface of "core 1", a ripening treatment was conducted at 75° c. for 20 minutes to form a shell.

Thereafter, an aqueous solution in which of 40.2 parts by weight of sodium chloride was dissolved in 1000 parts by weight was added to terminate shell formation. Further, the mixture was cooled to 30° C. at a cooling rate of 8° C./min, and the resulting colored particles were filtered and repeatedly washed with deionized water at 45° C., followed by drying with hot air at 40° C. to prepare "colored particle 1" having a shell on the core surface.

(c) External Additive Treatment:

The following external additives were added into "colored particle 1" and were subjected to an external additive treatment with a Henschel mixer (manufactured by Mitsui Miike Co.) to prepare "toner 1".

| | |
|---|---|
| Silica having been subjected to a hexamethylsilane treatment (average primary particle diameter of 12 nm) | 0.6 parts by weight |
| Titanium dioxide having been subjected to an n-octylsilane treatment (average primary particle diameter of 24 nm) | 0.8 parts by weight |

In addition, the external additive treatment with a Henschel mixer was conducted under the conditions of a stirring blade circumferential speed of 35 m/sec, a treatment temperature of 35° C., and a treatment time of 15 minutes.

2-2. Preparation of "Toners 2-23"

(1) Preparation of "Toners 2-5"

"Toners 2-5" were prepared similarly to preparation of "toner 1", except that addition amounts of "alophatic acid ester wax 1" and "docosanol" used in the second polymerization for preparation of the foregoing "core resin particle 1" were replaced by those shown in Table 2.

(1) Preparation of "Toners 6-12"

"Toners 6-12" were prepared similarly to preparation of the foregoing "toner 1", except that 9.8 parts by weight of "docosanol" used in the second polymerization for preparation of the foregoing "core resin particle 1" were replaced by the kind and the addition amount of an alcohol compound. In addition, an alcohol compound (#) used during preparation of "toner 10" is aliphatic alcohol having 40 carbon atoms, which is composed of the following structure. Further, an alcohol compound (# #) used during preparation of "toner 12" is aliphatic alcohol having 42 carbon atoms, which is composed of the following structure.

Aliphatic alcohol having 40 carbon atoms (# in Table 2)

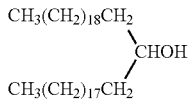

Aliphatic alcohol having 42 carbon atoms (# # in Table 2)

$CH_3(CH_2)_{40}CH_2OH$ (3) Preparation of "Toners 13-22"

"Toners 13-21" were prepared similarly to preparation of the foregoing "toner 1", except that 84.0 parts by weight of "fatty acid ester wax 1" used in the second polymerization for preparation of the foregoing "toner 1" were replaced by the kind and the addition amount of a fatty acid ester compound as shown in Table 2. Further, "toner 22" was prepared similarly to preparation of the foregoing "toner 1", except that addition of "docosanol" was replaced by addition of 90.0 parts by weight of "fatty acid ester wax 1".

(4) Preparation of "Toner 23"

A resin particle dispersion was prepared to obtain "core resin particle dispersion 2", similarly to preparation of the foregoing "toner 1", except that the resin particle dispersion was prepared without adding "fatty acid ester wax 1" and "docosanol" in the second polymerization for preparation of the foregoing "toner 1".

Next, "toner 23" was prepared similarly to preparation of the foregoing "toner 1", except that those described below were charged and stirred in a reaction vessel fitted with a stirrer, a temperature sensor, a condenser and a nitrogen gas introducing device in the core formation for preparation of the foregoing "toner 1". As to "toner 23" prepared in the above-described procedure, The content of "fatty acid ester wax 1" and "docosanol" was set to the same content as that of the foregoing "toner 1".

| | |
|---|---|
| Core resin particle 2 | 420 parts by weight (solid content conversion) |
| Deionized water | 900 parts by weight |
| Colorant particle C | 200 parts by weight (solid content conversion) |
| Particle D formed from a mixture of "fatty acid ester 1" and "docosanol" | 200 parts by weight (solid content conversion) |

Configurations of "toners 1-23" prepared in the above-described procedure are shown in Table 2. In addition, "alcohol ratio (mol %)" is represented by an addition amount of aliphatic alcohol into toner with respect to fatty acid ester wax.

TABLE 2

| | Fatty acid ester wax | | Alcohol | | | |
|---|---|---|---|---|---|---|
| Toner No. | No. | Addition amount (parts by weight) | Kinds | The number of carbon atoms | Addition amount (parts by weight) | Alcohol ratio (mol %) |
| 1 | 1 | 84.0 | Docosanol | 22 | 9.8 | 39.9 |
| 2 | 1 | 77.8 | Docosanol | 22 | 16.0 | 70.4 |
| 3 | 1 | 92.4 | Docosanol | 22 | 1.4 | 5.2 |
| 4 | 1 | 93.2 | Docosanol | 22 | 0.6 | 2.2 |
| 5 | 1 | 73.8 | Docosanol | 22 | 20.0 | 92.8 |
| 6 | 1 | 85.4 | Octadecanol | 18 | 8.4 | 40.7 |
| 7 | 1 | 83.2 | Decanol | 10 | 10.5 | 40.0 |
| 8 | 1 | 75.8 | Hexacosanol | 26 | 18.0 | 80.0 |
| 9 | 1 | 92.8 | Triacontanol | 30 | 1.0 | 3.0 |
| 10 | 1 | 86.0 | # | 40 | 7.8 | 40.8 |
| 11 | 1 | 81.5 | Octanol | 8 | 12.3 | 38.7 |
| 12 | 1 | 79.8 | ## | 42 | 14.0 | 40.2 |
| 13 | 2 | 82.3 | Docosanol | 22 | 11.5 | 40.6 |
| 14 | 3 | 80.0 | Docosanol | 22 | 13.8 | 40.5 |
| 15 | 4 | 79.8 | Docosanol | 22 | 14.0 | 40.4 |
| 16 | 5 | 92.3 | Docosanol | 22 | 1.5 | 3.2 |
| 17 | 5 | 77.8 | Docosanol | 22 | 16.0 | 40.9 |
| 18 | 5 | 67.3 | Docosanol | 22 | 26.5 | 78.3 |
| 19 | 6 | 93.1 | Docosanol | 22 | 0.7 | 3.3 |
| 20 | 6 | 85.8 | Docosanol | 22 | 8.0 | 40.7 |
| 21 | 6 | 79.5 | Docosanol | 22 | 14.3 | 78.6 |
| 22 | 1 | 90.0 | — | — | 0 | 0 |
| 23 | 1 | 84.0 | Docosanol | 22 | 9.8 | 39.9 |

3. Evaluation Experiment

"Toners 1-23" prepared in the above-described procedure were evaluated as described below. "Toners 1-15, and 23" satisfying the present invention are designated as "Examples 1-16", and "Toners 16-22" dissatisfying the present invention are designated as "Comparative examples 1-7", 3-1. Evaluation 1 (Evaluation of Toner Heat Resistance Storage)

The toner heat resistance storage was evaluated in the following procedure. In a 10 ml vial having an inner diameter of 21 mm, charged were 0.5 g of each of the foregoing toners, and after closing the lid of it, each vial was then shaken 600 times with a tap densor, "KYT-2000 (produced by Seishin Kigyo Co., Ltd.)" and after removing the lid of it, the vial was left standing for two hours at 57° C. and 35% RH. Next, the foregoing toner was placed on a sieve of 48 mesh (an opening of 350 μm) so as no to damage the toner, and was set on a powder tester (produced by Hosokawa Micron Co. Ltd.), while securing it with a pressure bar and a knob nut.

The foregoing powder tester was adjusted to a vibration intensity of a feeding width of 1 mm, and vibration was applied thereto for 10 seconds. Thereafter, the amount of toner remaining on the sieve was measured, and a remaining toner ratio was calculated to determine a toner aggregation ratio (% by weight). This was designated as the heat resistance storage evaluation.

The toner aggregation ratio was calculated by the following equation.

$$\text{Toner aggregation ratio(\% by weight)}=[\{\text{weight of toner remaining on sieve(g)}\}/0.5(\text{g})]\times 100.$$

The heat resistance storage was evaluated based on the following criteria

A: a toner aggregation ratio of less than 15% by weight (Excellent in toner heat resistance storage), B: a toner aggregation ratio of 15-20% by weight (Good in heat resistance storage)

C: a toner aggregation ratio exceeding 20% (No good in heat resistance storage)

In accordance with the above-described criteria, A and B indicate "pass".

3-1. Evaluation 2 (Evaluation of Image Performance)

(1) Preparation of "Developers 1-23"

A ferrite carrier having a volume average particle diameter of 35 μm, which was covered with a styrene acrylic resin, was mixed with each of the foregoing "toners 1-23" to prepare "developers 1-23" each having a toner concentration of 8%.

(2) Evaluation Experiment

The foregoing "developers 1-23" each were placed in an evaluation machine obtained by modifying a fixing device installed in a commercially available digital copying machine "bizhub PRO C500 (manufactured by Konica Minolta Business Technologies, Inc.) to evaluate tacking performance and fixing performance.

<Evaluation of Tacking Performance>

As to the tacking evaluation, two unfixed images output from a modified machine of the above-described digital copying machine were fixed with the above-described "developers 1-23" employing an external fixing device at a fixing temperature of 150° C. The two unfixed images lie on top of each other in such a way that the image portion and the non-image portion, or the image portion and the image portion are facing to each other, and a weight has been placed on the overlapped area so as to apply a load of 80 g/cm$^2$. This situation was left standing for 3 days in a constant temperature and constant humidity reservoir at a temperature of 60° C. and a humidity of 50% RH. After standing for 3 days, the overlapped portions of the two overlapped fixed images were evaluated based on the following criteria whether or not generation of image defects is present or absent.

"Excellent": No image defect caused by toner transfer is generated, and even slight tacking is hardly observed, resulting in no problem at all.

"Good": A zipping sound is made when separating overlapped images from each other, but no image defect caused by toner transfer is generated, resulting in no problem.

"Practically accepted": When separating overlapped images from each other, generation of gloss unevenness is observed in each of the images, but no generation of image defects is almost observed.

"No good": When separating overlapped images from each other, generation of image transfer is observed in non-image portions, and peeling caused by toner transfer between images having been brought into contact with each other are observed, resulting in no practical availability.

In accordance with the above-described criteria, "Excellent", "Good", and "Practically accepted" indicate "pass".

<Evaluation of Fixing Performance>

Developing was conducted so as to give a toner coating amount of 11 mg/cm$^2$ on a transfer paper sheet, employing the foregoing modified machine of a digital copying machine. The transfer paper sheet on which a toner image was formed was subjected to a fixing treatment at a temperature of 20° C. and a humidity of 50% RH by changing the temperature of a fixing heat roller in the range of 120-210° C. at 5° C. intervals.

A fixed image portion of transfer paper sheet was folded down by a folding machine and air at 0.35 MPa was sprayed onto the folded portion. The image at the folded portion was evaluated in accordance with the following criteria. Evaluation was based on five rankings and the fixing temperature corresponding to rank 3 was defined as the lower limit of the fixing temperature. A lower limit of fixing temperature of 150° C. or less was set to be "pass".

Rank 5: no fold was observed at all,

Rank 4: Peeling was slightly observed along the partial fold,

Rank 3: Line-shaped peeling was observed along the fold, but there is no practical problem, Rank 2: Line-shaped peeling was observed along the fold, and there is a practical problem.

Rank 1: Peeling is largely generated on the image.

The results are shown in Table 3.

TABLE 3

| | Heat resistance storage | | | | |
|---|---|---|---|---|---|
| | Toner | | | Image performance | |
| | Toner No. | aggregation ratio (%) | Evaluation | Tacking | Fixing performance |
| Ex. 1 | 1 | 8 | A | Good | 120° C. |
| Ex. 2 | 2 | 17 | B | Excellent | 115° C. |
| Ex. 3 | 3 | 16 | B | Good | 125° C. |
| Ex. 4 | 4 | 17 | B | Practically accepted | 125° C. |
| Ex. 5 | 5 | 20 | B | Excellent | 115° C. |
| Ex. 6 | 6 | 13 | A | Good | 120° C. |
| Ex. 7 | 7 | 9 | A | Good | 125° C. |
| Ex. 8 | 8 | 12 | A | Good | 120° C. |
| Ex. 9 | 9 | 17 | B | Good | 120° C. |
| Ex. 10 | 10 | 17 | B | Excellent | 115° C. |
| Ex. 11 | 11 | 8 | A | Practically accepted | 130° C. |
| Ex. 12 | 12 | 18 | B | Good | 120° C. |
| Ex. 13 | 13 | 9 | A | Good | 125° C. |
| Ex. 14 | 14 | 10 | A | Good | 130° C. |
| Ex. 15 | 15 | 12 | A | Excellent | 115° C. |
| Ex. 16 | 23 | 9 | A | Good | 120° C. |
| Comp. 1 | 16 | 17 | B | No good | 135° C. |
| Comp. 2 | 17 | 42 | C | Excellent | 130° C. |
| Comp. 3 | 18 | 22 | C | Practically accepted | 125° C. |
| Comp. 4 | 19 | 28 | C | Practically accepted | 150° C. |
| Comp. 5 | 20 | 42 | C | Practically accepted | 145° C. |
| Comp. 6 | 21 | 18 | B | No good | 140° C. |
| Comp. 7 | 22 | 40 | C | No good | 130° C. |

Ex.: Example,
Comp: Comparative example

As is clear from Table 3, it is confirmed that "Examples 1-16" having the configuration of the present invention exceed any of the prescribed levels of heat resistance storage, tacking performance, and fixing performance, resulting in producing of effects of the present invention. In contrast, it is confirmed that "Comparative examples 1-7" dissatisfying the configuration of the present invention do not exceed at least one of the prescribed levels of heat resistance storage, tacking performance, and fixing performance, whereby no effect of the present invention thereof is produced.

EXPLANATION OF NUMERALS

1 (1Y, 1M, 1C, and 1Bk) Photoreceptor
2 Charging device
3 Image exposure device
4 (4Y, 4M, 4C, and 4Bk) Developing device (developing means)
5 (5Y, 5M, 5C, and 5Bk) Primary transfer device (primary transfer roller)
6 (6Y, 6M, 6C, and 6Bk) Cleaning device (cleaning means)
10 (10Y, 10M, 10C, and 10Bk) Image forming section
50 Fixing device
70 (Endless-belt-shaped) intermediate transfer body
A Image reading section
B Image processing section
D Transfer paper conveyance section
P Transfer material (transfer paper or recording member)

The invention claimed is:

1. A toner comprising at least a binder resin, a colorant, an aliphatic alcohol, and a fatty acid ester wax having a hydroxyl group, wherein the fatty acid ester wax is a dehydrating condensation reactant made from an aliphatic alcohol and one selected from a citric acid, a dihydroxysuccinic acid and a malic acid.

2. The toner of claim 1, wherein the aliphatic alcohol has 10-40 carbon atoms.

3. The toner of claim 1, wherein the aliphatic alcohol is contained in an amount of 3-80 mol %, based on the fatty acid ester wax having a hydroxyl group.

4. A developer comprising the toner of claim 1.

5. A method of manufacturing a toner comprising a binder resin, a colorant, and a wax, comprising the steps of:

polymerizing polymerizable monomers comprising an aliphatic alcohol and a fatty acid ester wax comprising a hydroxyl group which is a dehydrating condensation reactant made from an aliphatic alcohol and one selected from a critric acid, a dihydroxysuccinic acid and a malic acid to form resin particles constituting the binder resin, and coagulating/fusing the resin particles and colorant particles to prepare the toner.

6. A method of manufacturing a toner comprising a binder resin, a colorant and a wax, comprising the step of:

coagulating/fusing resin particles constituting the binder resin having been formed via polymerization of polymerizable monomers; admixture particles formed from an aliphatic alcohol and a fatty acid ester wax comprising a hydroxyl group which is a dehydrating condensation reactant made from an aliphatic alcohol and one selected from a critric acid, a dihydroxysuccinic acid and a malic acid; and colorant particles to prepare the toner.

* * * * *